US007018585B2

(12) United States Patent
Hsu

(10) Patent No.: US 7,018,585 B2
(45) Date of Patent: Mar. 28, 2006

(54) ANNEALING APPARATUS

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/843,627

(22) Filed: May 12, 2004

(65) Prior Publication Data

US 2005/0012254 A1 Jan. 20, 2005

(30) Foreign Application Priority Data

Jul. 18, 2003 (TW) ..... 92213134 U

(51) Int. Cl.
*C21D 1/74* (2006.01)

(52) U.S. Cl. ..... 266/255; 432/152

(58) Field of Classification Search ..... 266/255, 266/252; 432/152, 153

See application file for complete search history.

(56) References Cited

U.S. PATENT DOCUMENTS 3,415,503 A * 12/1968 Beck ..... 432/152
3,467,366 A * 9/1969 Kimball et al. ..... 432/152

FOREIGN PATENT DOCUMENTS

JP 406074655 A * 3/1994 ..... 432/152

OTHER PUBLICATIONS

English language Translation of JP406074655A.*

* cited by examiner

*Primary Examiner*—Scott Kastler

(57) ABSTRACT

An annealing apparatus includes a gas tight hollow main body, a conveying apparatus and a gas grid. A heating apparatus and a cooling apparatus are installed at an inlet and an outlet of the main body, respectively. The gas grid is installed between the inlet and the outlet to blow the protecting gas into the main body, so as to form a gas screen. The conveying apparatus extends to the inlet and the outlet to convey process material such as heat pipe. Thereby, an open, non-pressure differential environment is established for performing annealing on the process material.

18 Claims, 5 Drawing Sheets

ANNEALING APPARATUS

BACKGROUND OF THE INVENTION

The present invention relates in general to an annealing apparatus, and more particularly, to an annealing apparatus operative to provide an open and non-pressure differential environment for continuously perform annealing on a process material such as a heat pipe without oxidizing and affecting the luster of the process material.

The conventional thermal process of a heat pipe includes a step of annealing. To avoid oxidizing the heat ppe and to provide a clean process, the annealing process is normally performed in a vacuum furnace.

The conventional annealing process performed in a vacuum furnace requires a specific number of heat pipe materials disposed in a vacuum furnace. The vacuum furnace is then closed, vacuumed and heated to perform the annealing process. After the annealing process, the heat pipe materials are removed for subsequent process, and a new batch of heat pipe materials is disposed in the vacuum furnace for annealing.

Therefore, only a limited number of heatpipes can be annealed each time. The remaining heat pipes have to wait until the annealing process performed on the previous batch is complete and removed from the vacuum furnace, and the vacuum furnace is reopen and set up again. The conventional batch-by-batch process is thus very time consuming. Further, as the furnace is heated under an airtight vacuum status. Careless or inadvertent operation may cause serious injury or damage.

SUMMARY OF THE INVENTION

The present invention provides an annealing apparatus which provides an open, non-pressure differential environment to perform annealing on process materials such as heat pipes. Therefore, the risk of setting up and maintain the vacuum and high-pressure condition is eliminated. In addition, the annealing process can be continuously performed, such that the fabrication efficiency is greatly enhanced.

The present invention further provides an annealing apparatus which provides a safe, lost-cost and fast annealing process. The annealing process will not oxidize or affect the luster of the surface of the process materials. Therefore, the conventional annealing performed in a vacuum furnace can be substituted.

The annealing apparatus includes a closed hollow main body, a conveying apparatus and at least one gas grid. The main body includes a material inlet and a material outlet communicative to each other. The annealing apparatus further includes a heating apparatus at the inlet, and the gas is installed between the heating apparatus and the outlet. The gas grid is operative to blow protecting gas into the main body, so as to form a gas screen. The conveying apparatus extends from the inlet to the outlet to convey the process material from the inlet to the outlet. Thereby, an open and non-pressure differential environment is provided to anneal the process materials.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF ACCOMPANIED DRAWINGS

The above objects and advantages of the present invention will be become more apparent by describing in detail exemplary embodiments thereof with reference to the attached drawings in which.

DETAILED DESCRIPTION OF EMBODIMENT

Figure 1:
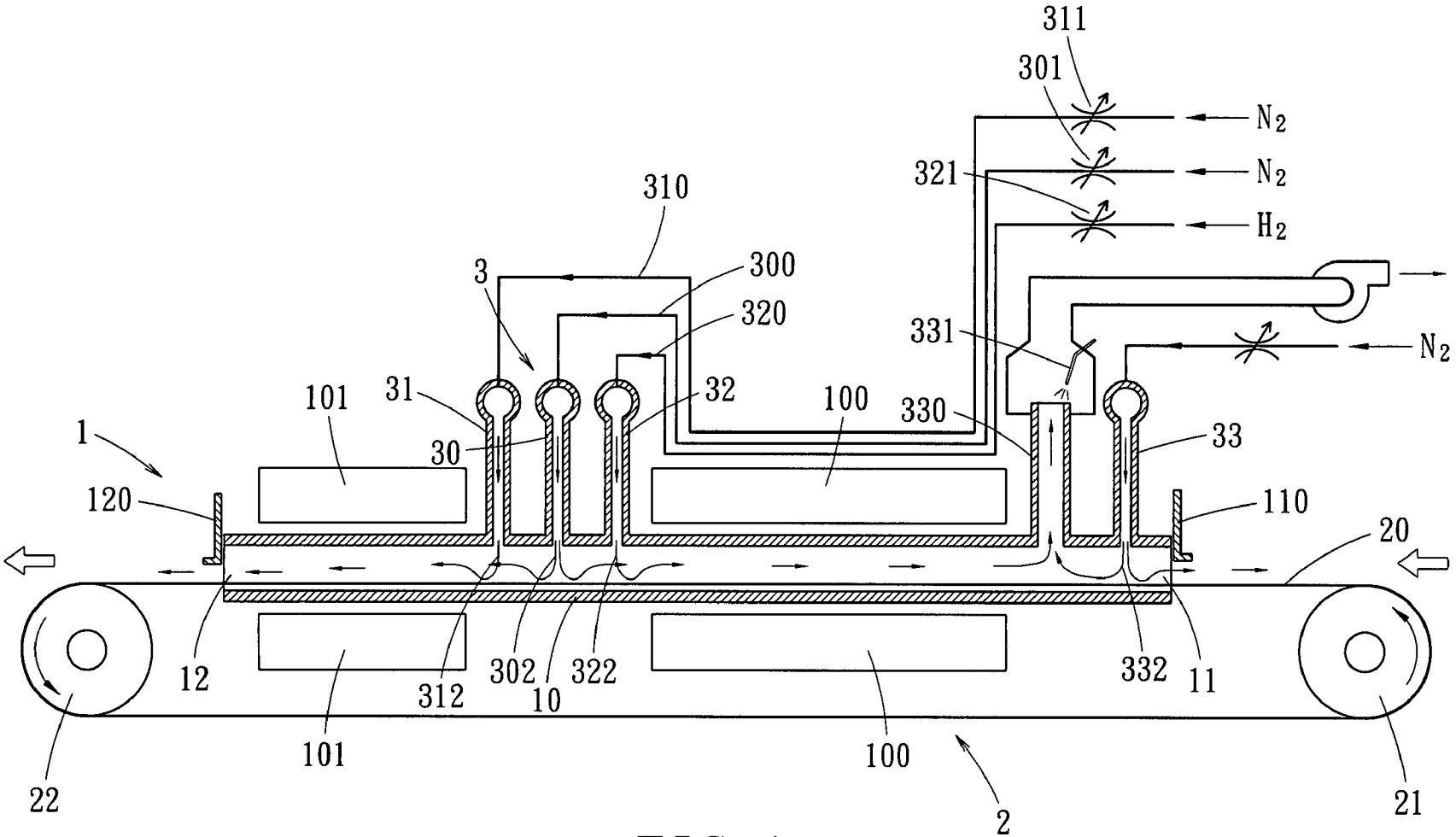
FIG. 1 illustrates a cross sectional view of an annealing apparatus in one embodiment of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
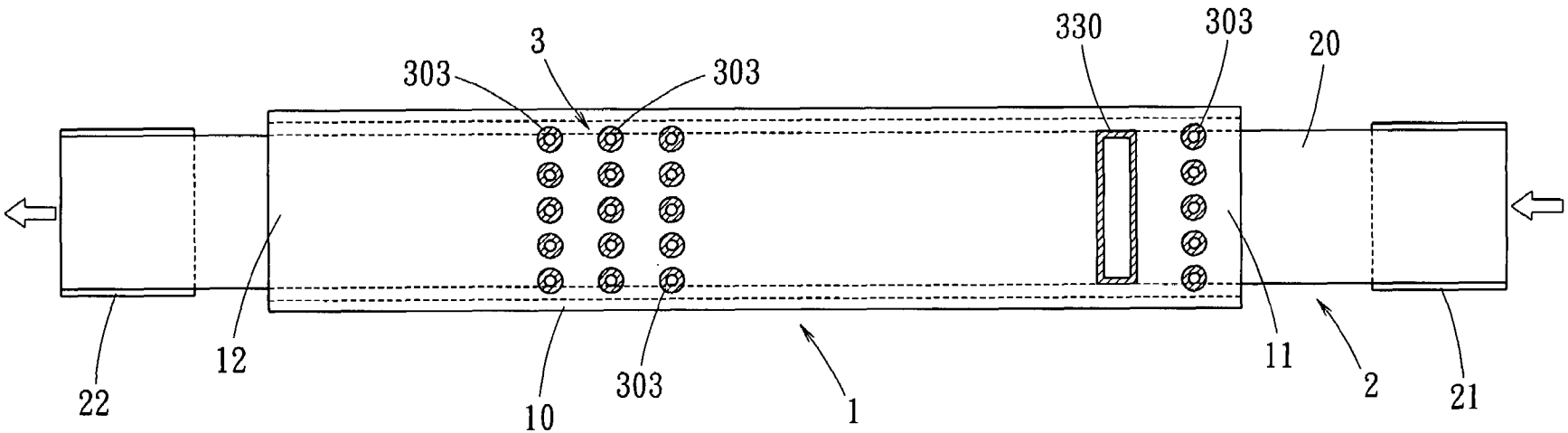
FIG. 2 shows a top view of the annealing apparatus.

FIGS. 1 and 2 show a cross-sectional view and a top view of an annealing apparatus to perform annealing process on process materials such as heat pipes (not shown). The annealing apparatus includes a main body 1, a conveying apparatus 2 and a gas grid 3.

Figure 5:
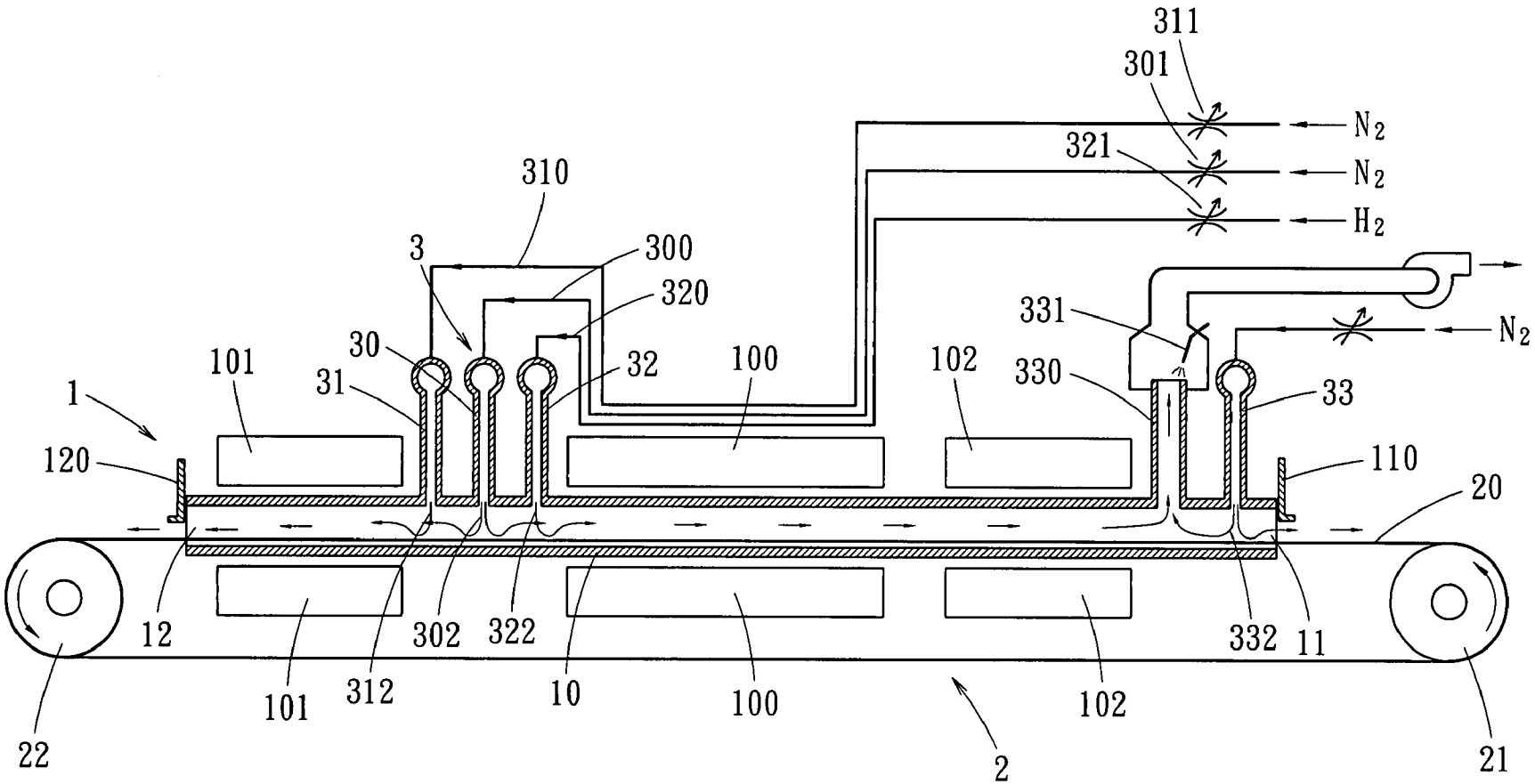
FIG. 5 a cross sectional view of a cooling apparatus.

The main body 1 includes an elongate cylindrical hollow furnace having a gastight sidewall 10. One end of the main body 1 includes a material inlet 11 and the other end of the main body 2 includes a material outlet 12. The inlet 11 and the outlet 12 are in communication with the ambient to provide an open status of the process materials. Thereby, process materials such as heat pipes can be disposed in the annealing apparatus any time during the annealing process. A heating apparatus 100 is installed in the main body 1 proximal to the inlet 11, and a cooling apparatus 101 is installed in the main body 1 proximal to the outlet 12. An additional cooling apparatus 102 may further be installed between the heating apparatus 100 and the inlet 11 as shown in FIG. 5. It appreciated that the first and second cooling apparatus 101 and 102 are optional. A naturally cooling process may also be used alternatively.

The conveying apparatus 2 is operative to convey process materials such as heat pipes into the main body 1 from the inlet 11. The process materials are subjected to heating and cooling process while passing through the heating apparatus 100 and the cooling apparatus 101, respectively. The process materials are then removed from the main body 1 from the outlet 12. Thereby, the process materials can be continuously conveyed and processed by the annealing apparatus. In this embodiment, the conveying apparatus 2 includes a conveyor belt 20 and two drive wheels 21 and 22 located at the inlet 11 and the outlet 12 outside of the main body for driving the conveyor belt 20. The conveyor belt 20 extends through the inlet 11 and the outlet 12, such that the process materials can be conveyed from the inlet 11 to the outlet 12.

The gas grid 3 is mounted on the main body 1 and connected thereto. The gas grid 3 is preferably installed between the heating apparatus 100 and the cooling apparatus to blow protecting gas such as nitrogen ($N_2$) or argon (Ar) into the main body 1, so as to form a gas screen 302 and 312, respectively. When the gas screen 302 is in contact with the internal sidewall of the main body 1, two gas flows are formed to flow from the inlet 11 towards the outlet 12 (indicated by the arrows as shown in FIG. 1). Thereby, the internal air of the main body 1 is exhausted, and the process materials conveyed inside of the main body 1 are well protected thereby. Therefore, the oxidation gas in the main body 1 is expelled, such that the process materials will not be oxidized during the annealing process, and the luster of the process materials will not be affected.

Figure 3:
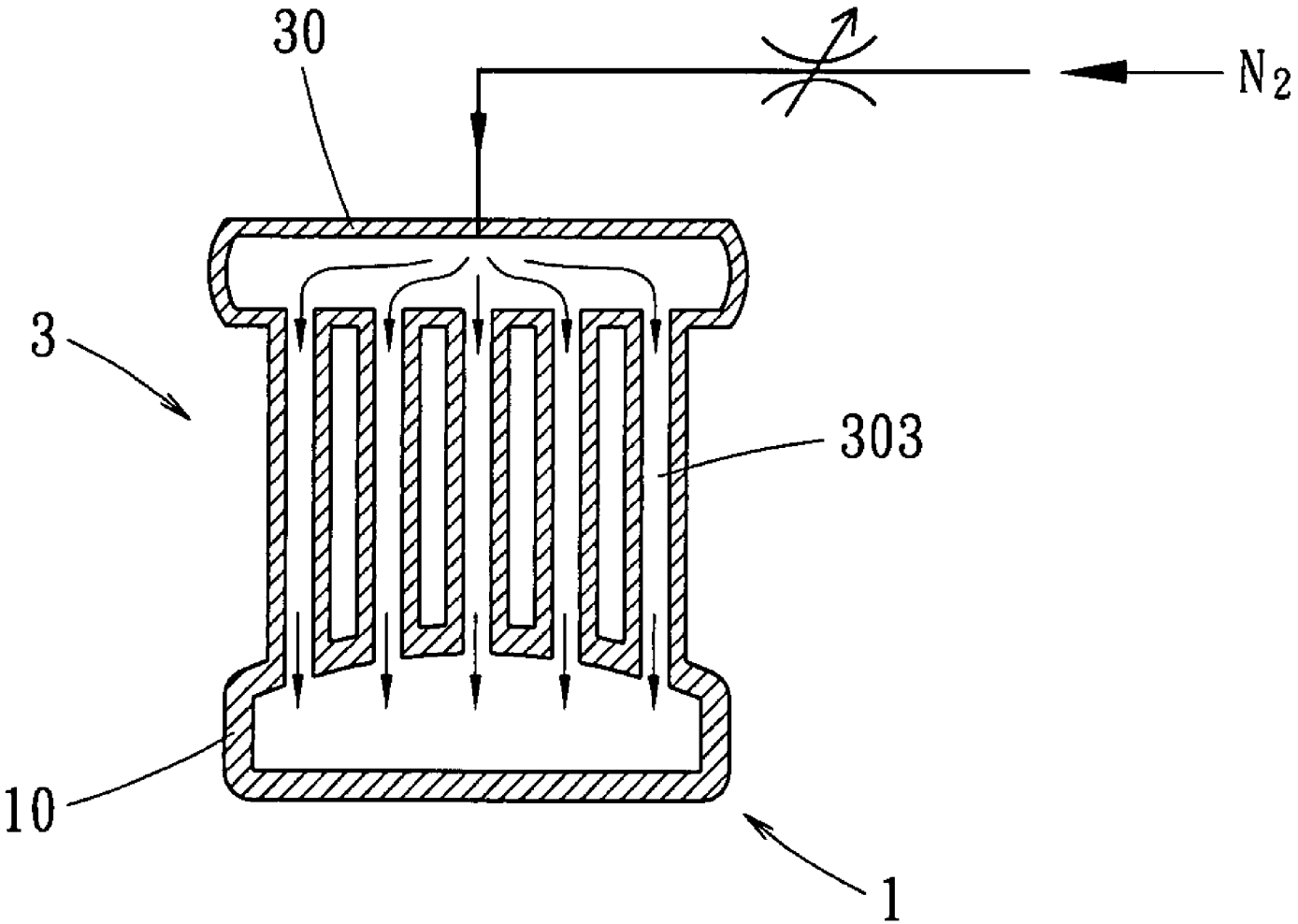
FIG. 3 shows one side of a gas grid of the annealing apparatus.

In the embodiment as shown in FIG. 3, a first gas grid 30 and a second gas grid 31 are installed along the conveyor belt 20. Pipes 300 and 310 are connected to the protection gas supply (not shown). Control units 301 and 311 are installed at the pipes 300 and 310 to control the gas pressure and flow rate of the gas grid 30 and 31, respectively. Therefore, the flow rate of the protecting gas expelled from the inlet 11 to the outlet 12 can be adjusted.

In addition, as shown in FIG. 1, reduction gas grid 32 can be installed between the heating apparatus 100 and the gas grid 3. The reduction gas grid 32 is operative to blow reduction gas such as hydrogen ($H_2$) into the main body 1. Similarly, the reduction gas grid 32 is connected to a reduction gas supply (not shown) by a pipe 320, and a control unit 321 is installed at the pipe 320 to control the gas pressure and flow rate.

To avoid the operator being poisoned by poisoning, high-temperature or dirty gas exhausted from the outlet 11 during annealing process, a baffle gas grid 33 and an exhaust pipe 330 are installed in the main body 1 near the inlet 11. The baffle gas grid 33 is located between the inlet 11 and the exhaust pipe 330. Therefore, the gas screen produced by the baffle gas grid 33 prevents the gas inside the main body 1 exhausted from the inlet 11. The gas inside the main body 1 is thus vented towards a specific position to be processed. An ignition apparatus 331 such as a fire gun can be installed at the exit of the exhaust pipe 330. Thereby, the flammable portion of the gas can be burned before being exhausted out of the annealing apparatus.

In addition, gas valves 110 and 120 can be installed at the inlet 11 and the outlet 12 to adjust the gas exhausted therefrom.

Figure 4:
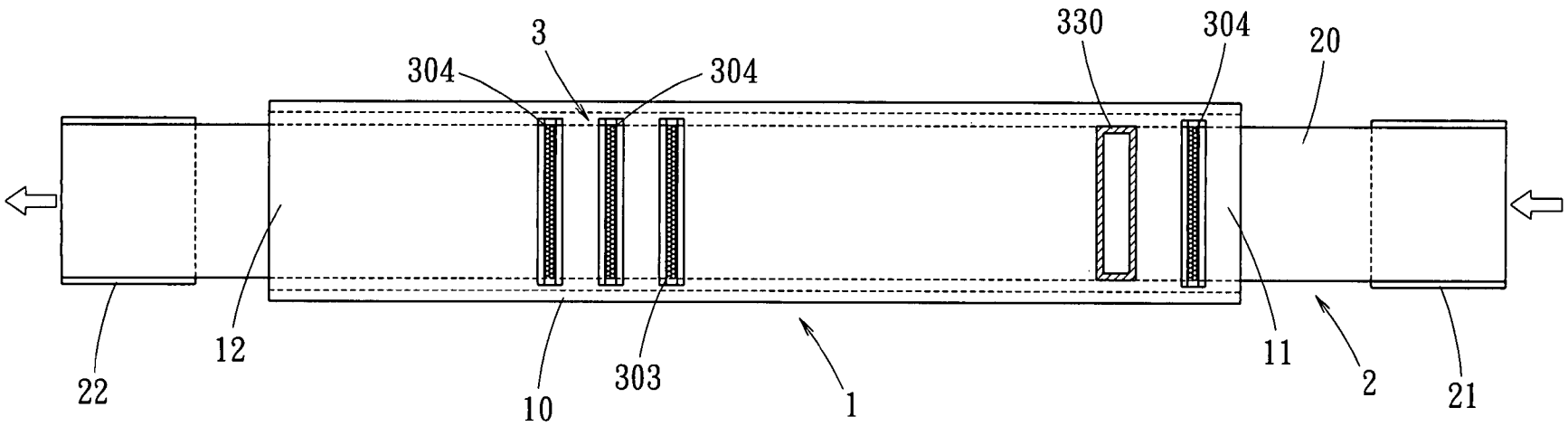
FIG. 4 shows a top view of an annealing apparatus in another embodiment of the present invention.

As shown in FIGS. 2 and 3, the above gas grid 3, the reduction gas grid 32, or the baffle gas grid 33 includes a plurality of vertical tubes 303 extending along the conveyor belt 20 to form a stable baffle gas screen serving as a fairing. As shown in FIG. 4, a beehive rectangular gas channel 304 is formed to extend perpendicular to the moving direction of the conveyor belt 20. The gas screens 302, 312, 322 and 332 produced by gas grid 3, the reduction gas grid 32 or the baffle gas grid 33 has a width of at least one half of the internal width of the main body 1.

While the present invention has been particularly shown and described with reference to preferred embodiment thereof, it will be understood by those of ordinary skill in the art the various changes in form and details may be made therein without departing from the spirit and scope of the present invention as defined by the appended claims.

What is claimed is:

1. An annealing apparatus, comprising:

a hollow main body having a gastight periphery, wherein the hollow main body comprises an open inlet at one end thereof and an open outlet at the other end thereof;

a conveying apparatus extending through the main body from the inlet to the outlet;

a heating apparatus located along the conveying apparatus, the heating apparatus being oriented towards the outlet; and a gas grid to blow protecting gas into the main body, so as to form a gas screen inside the main body, wherein when the gas screen is in contact with the internal sidewall of the main body, two gas flows are formed to respectively flow towards the inlet and the outlet for exhausting, thereby oxidation gas in the main body is expelled from the inlet end the outlet.

2. The apparatus as claimed in claim 1, wherein the main body includes an elongate cylindrical tube encircled by a gastight sidewall.

3. The apparatus as claimed in claim 1, further comprising an adjusting gas grid at each of the inlet and the outlet.

4. The apparatus as claimed in claim 1, further comprising a cooling apparatus disposed between the gas grid and the outlet inside of the main body.

5. The apparatus as claimed in claim 4, further comprising an additional cooling apparatus disposed between the heating apparatus and the inlet.

6. The apparatus as claimed in claim 1, wherein the conveying apparatus comprises a conveyor belt extending through the inlet and the outlet and two drive wheels at the inlet and the outlet outside of the main body to drive the conveyor belt.

7. The apparatus as claimed in claim 1, wherein the gas grid includes a plurality of vertical pipes extending towards the outlet.

8. The apparatus as claimed in claim 1, wherein the gas grid includes a beehive rectangular wind channel perpendicular to the conveyor belt.

9. The apparatus as claimed in claim 1, wherein the width of the gas screen produced by the gas grid is at least one half of an internal width of the main body.

10. The apparatus as claimed in claim 1, wherein the gas grid is connected to a protecting gas supply via a pipe, and the pipe comprises a control unit to control pressure and flow rate of the protecting gas.

11. The apparatus as claimed in claim 1, wherein gas grid comprises a first gas grid and a second gas grid arranged sequentially from the inlet towards the outlet.

12. The apparatus as claimed in claim 1, further comprising a reduction gas grid disposed between the heating apparatus and the gas grid to blow reduction gas into the main body.

13. The apparatus as claimed in claim 12, wherein the reduction gas grid is connected to a reduction gas supplied via a pipe, and the pipe comprises a control unit to control pressure and flow rate of the reduction gas.

14. The apparatus as claimed in claim 1, further comprising an exhaust pipe installed proximal to the inlet of the main body.

15. The apparatus as claimed in claim 14, further comprising an ignition device at an outlet of the exhaust pipe.

16. The apparatus as claimed in claim 15, wherein the ignition device comprises a fire gun.

17. The apparatus as claimed in claim 14, further comprising a baffle gas grid installed between the exhaust pipe and the inlet.

18. The apparatus as claimed in claim 1, further comprising two gas valves respectively installed at the inlet and the outlet to adjust the gas exhausted therefrom.

* * * * *